US010371391B2

(12) United States Patent
Tcaciuc

(10) Patent No.: US 10,371,391 B2
(45) Date of Patent: Aug. 6, 2019

(54) COOKING OVEN PROVIDED FOR HEAT TRANSFER BY CONVECTION

(71) Applicant: Electrolux Home Products Corporation N.V., Brussels (BE)

(72) Inventor: Sorin Tcaciuc, Satu Mare (RO)

(73) Assignee: Electolux Home Products Corporation N.V., Brussels (BE)

( * ) Notice: Subject to any disclaimer, the term of this patent is extended or adjusted under 35 U.S.C. 154(b) by 1164 days.

(21) Appl. No.: 14/370,290

(22) PCT Filed: Jan. 18, 2013

(86) PCT No.: PCT/EP2013/050893

§ 371 (c)(1),
(2) Date: Jul. 2, 2014

(87) PCT Pub. No.: WO2013/131673

PCT Pub. Date: Sep. 12, 2013

(65) Prior Publication Data

US 2015/0000539 A1 Jan. 1, 2015

(30) Foreign Application Priority Data

Mar. 8, 2012 (EP) ..... 12158591

(51) Int. Cl.
*F24C 15/32* (2006.01)
*F24C 15/00* (2006.01)

(52) U.S. Cl.
CPC ..... *F24C 15/322* (2013.01); *F24C 15/006* (2013.01); *F24C 15/325* (2013.01)

(58) Field of Classification Search
USPC .... 126/19 R, 20, 20.1, 20.2, 21 R, 21 A, 22, 126/19 M; 219/600–677, 200, 201–270,
(Continued)

(56) References Cited

U.S. PATENT DOCUMENTS 3,776,122 A * 12/1973 Julian ..... F24F 7/007 416/246
4,010,341 A * 3/1977 Ishammar ..... F24C 15/322 126/21 A (Continued)

FOREIGN PATENT DOCUMENTS

DE 102007059770 A1 6/2009
DE 102010030407 A1 12/2011

(Continued)

OTHER PUBLICATIONS

International Search Report for PCT/EP2013/050893, dated Jun. 6, 2013, 2 pages.

(Continued)

*Primary Examiner* — Ibrahime A Abraham
*Assistant Examiner* — Gyounghyun Bae
(74) *Attorney, Agent, or Firm* — Pearne & Gordon LLP

(57) ABSTRACT

The present invention relates to a cooking oven provided for heat transfer by convection, in particular for a domestic appliance. The cooking oven comprises at least one top convection fan (12) arranged in a central portion of a top wall of an oven cavity (10) and at least one rear convection fan (14) arranged in a central portion of a rear wall of the oven cavity (10). The cooking oven comprises at least one top heating element (16, 18) arranged in an upper portion of the oven cavity (10) and below the top wall of said oven cavity (10) and at least one rear heating element (40) arranged in a rear portion of the oven cavity (10) and in front of the rear wall of said oven cavity (10). The top convection fan (12) and the rear convection fan (14) are axial fans. At least one top propeller (32) of the top convection fan (12) and at least one rear propeller (36) of the rear convection fan (14) are arranged inside the oven cavity (10).

16 Claims, 6 Drawing Sheets

Figure 1:
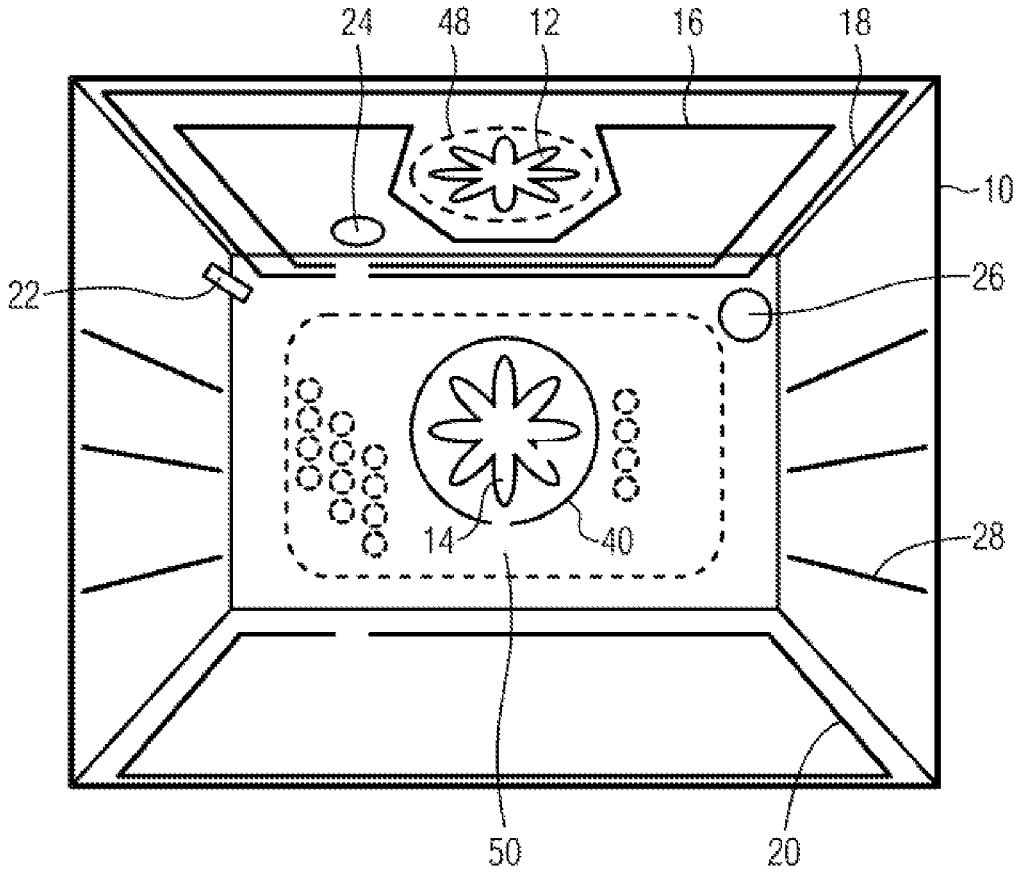

(58) Field of Classification Search
USPC ..... 219/383–553; 99/324–450
See application file for complete search history.

(56) References Cited

U.S. PATENT DOCUMENTS 4,020,323 A * 4/1977 Dills ..... F24C 7/06 126/41 R
4,097,709 A * 6/1978 Bachtold ..... A21B 2/00 219/681
4,191,877 A * 3/1980 Tanaka ..... H05B 3/06 219/685
4,295,034 A 10/1981 Assmann
4,327,279 A * 4/1982 Guibert ..... A23L 3/365 126/110 A
4,357,522 A * 11/1982 Husslein ..... F24C 15/325 219/400
4,471,195 A * 9/1984 Ishii ..... A47J 37/047 219/518
4,481,396 A * 11/1984 Matsubayashi ..... F24C 15/006 126/21 A
4,535,226 A 8/1985 Logel et al.
4,561,348 A 12/1985 Halters et al.
4,601,279 A * 7/1986 Guerin ..... F24C 14/02 126/21 A
4,743,728 A * 5/1988 Nagafusa ..... H05B 6/725 126/21 A
4,780,596 A * 10/1988 Matsushima ..... F24C 15/325 126/21 A
4,940,869 A * 7/1990 Scholtes ..... F24C 15/325 126/21 A
5,485,780 A * 1/1996 Koether ..... F24C 15/006 219/400
5,588,830 A * 12/1996 Josefsson ..... F26B 3/283 34/476
5,590,583 A * 1/1997 Harrison ..... A47J 37/0623 126/21 A
5,695,668 A * 12/1997 Boddy ..... F24C 7/087 126/21 A
5,801,362 A * 9/1998 Pearlman ..... A47J 37/0623 126/21 A
6,323,472 B1 * 11/2001 Coleman ..... H05B 6/6482 219/395
6,870,136 B1 * 3/2005 Majordy ..... F27D 7/04 219/400
6,949,720 B1 * 9/2005 Munoz ..... F24C 7/06 219/390
7,411,160 B2 * 8/2008 Duncan ..... F24C 15/325 126/21 A
8,106,334 B2 * 1/2012 Nam ..... F24C 15/322 126/21 A
8,258,435 B2 * 9/2012 Bonuso ..... F24C 15/325 126/21 A
8,950,319 B2 * 2/2015 Nam ..... H05B 6/6476 126/21 A
2004/0035845 A1 * 2/2004 Moon ..... A47J 37/0623 219/400
2004/0035857 A1 * 2/2004 Eke ..... H05B 6/705 219/679
2004/0200827 A1 * 10/2004 Bennett ..... F24C 7/082 219/491
2005/0252903 A1 * 11/2005 Maki ..... H05B 3/143 219/270
2006/0278632 A1 * 12/2006 Tai ..... H02G 3/20 220/3.2
2007/0003899 A1 * 1/2007 Lipscomb ..... A24B 1/02 432/227
2007/0158340 A1 * 7/2007 Kim ..... F24C 15/04 219/741
2008/0190911 A1 * 8/2008 Adamski ..... F24C 15/325 219/400
2009/0050619 A1 * 2/2009 Yang ..... F24C 7/06 219/400
2010/0018961 A1 * 1/2010 Roh ..... F24C 7/082 219/447.1
2010/0224616 A1 * 9/2010 Yasuhara ..... F24C 15/327 219/401
2010/0303985 A1 * 12/2010 De' Longhi ..... A47J 37/10 426/438
2011/0132572 A1 * 6/2011 Sato ..... F26B 15/04 165/61
2011/0214661 A1 * 9/2011 Hyun ..... F24C 15/006 126/21 A

FOREIGN PATENT DOCUMENTS

| | | |
|---|---|---|
| EP | 1542511 | 6/2005 |
| GB | 2054833 | 2/1981 |
| JP | 58153908 | 10/1983 |
| JP | 9126463 | 5/1997 |

OTHER PUBLICATIONS

Office action issued in corresponding Australian Patent Application No. 2013230261 dated Feb. 2, 2017, 4 pages.

* cited by examiner

COOKING OVEN PROVIDED FOR HEAT TRANSFER BY CONVECTION

The present invention relates to a cooking oven provided for heat transfer by convection according to the preamble of claim 1. In particular, the present invention relates to a cooking oven for a domestic appliance.

A conventional cooking oven using the forced air convection mode comprises usually a convection fan arranged at the rear wall of the oven cavity. However, the convection fan at the rear wall generates an asymmetric airflow distribution resulting in an unbalanced heat distribution at the walls of the oven cavity. Further, the heat transfer from the heating elements to the food stuff is uneven distributed, since a single swirling path is directed to the rear wall of the oven cavity. Sometimes the food stuff may be strongly browned close to the rear wall of the oven cavity. The speed of the airflow in the vicinity of the top heating elements is very low, so that the heat transfer from said top heating elements to the food stuff is constricted.

It is an object of the present invention to provide a cooking oven for heat transfer by convection, wherein the airflow inside the oven cavity is improved.

The object of the present invention is achieved by the cooking oven according to claim 1.

The cooking oven according to the present invention is provided for heat transfer by convection and comprises:

- at least one top convection fan arranged in a central portion of a top wall of an oven cavity,
- at least one rear convection fan arranged in a central portion of a rear wall of the oven cavity,
- at least one top heating element arranged in an upper portion of the oven cavity and below the top wall of said oven cavity, and
- at least one rear heating element arranged in a rear portion of the oven cavity and in front of the rear wall of said oven cavity, wherein
- the top convection fan and the rear convection fan are axial fans, and wherein
- at least one top propeller of the top convection fan and at least one rear propeller of the rear convection fan are arranged inside the oven cavity.

The main idea of the present invention is the cooperation of the top convection fan and the rear convection fan. The top convection fan and the rear convection fan provide a double swirling effect. The top convection fan generates a swirling along a vertical direction. In a similar way, the rear convection fan generates a swirling along a horizontal direction at the same time. The top convection fan and the rear convection fan generate two main streams of hot air. The one main stream of hot air extends along a vertical direction. The other main stream of hot air extends along a horizontal direction. This results in strong turbulences in the central portions of the oven cavity, while laminar airflows occur close to the walls of said oven cavity.

The top convection fan and the rear convection fan are axial fans and suck the air from the inner oven cavity to the top wall and side, respectively.

The cooking oven according to the present invention allows a reduced cooking time, when the top convection fan and the rear convection fan are activated. The energy consumption is also reduced.

Preferably, the rear heating element encloses the rear propeller of the rear convection fan.

For example, the rear heating element includes at least one circular heating element enclosing the rear propeller of the rear convection fan.

According to one embodiment of the present invention the top propeller of the top convection fan is arranged in the same horizontal plane as the at least one top heating element.

In particular, the at least one top heating element encloses the top propeller of the top convection fan in the horizontal plane.

According to another embodiment of the present invention the top propeller of the top convection fan is arranged above the at least one top heating element.

For example, the top propeller of the top convection fan is arranged inside a recess formed in the top wall of the oven cavity.

Further, the cooking oven may comprise at least one inner top heating element and at least one outer top heating element.

Preferably, the outer top heating element encloses the inner top heating element, wherein the inner top heating element and the outer top heating element are in the same horizontal plane. The inner top heating element may be provided for grilling purposes.

Moreover, at least one bottom heating element may be arranged below a bottom wall of the oven cavity. Thus, the bottom heating element may be arranged outside the oven cavity.

In particular, the cooking oven may comprise at least one cooling channel arranged above the oven cavity.

For example, the cooling channel extends from an exhaust in the top wall of the oven cavity to a front side of the cooking oven.

Further, the top convection fan may comprise at least one further top propeller arranged inside the cooling channel.

In particular, the top convection fan may comprise an upper top propeller arranged inside the cooling channel and a lower top propeller arranged inside the oven cavity.

At last, the upper top propeller and the lower top propeller may be attached at one vertical motor shaft of the top convection fan. This contributes to a low complexity.

Novel and inventive features of the present invention are set forth in the appended claims.

Figure 2:
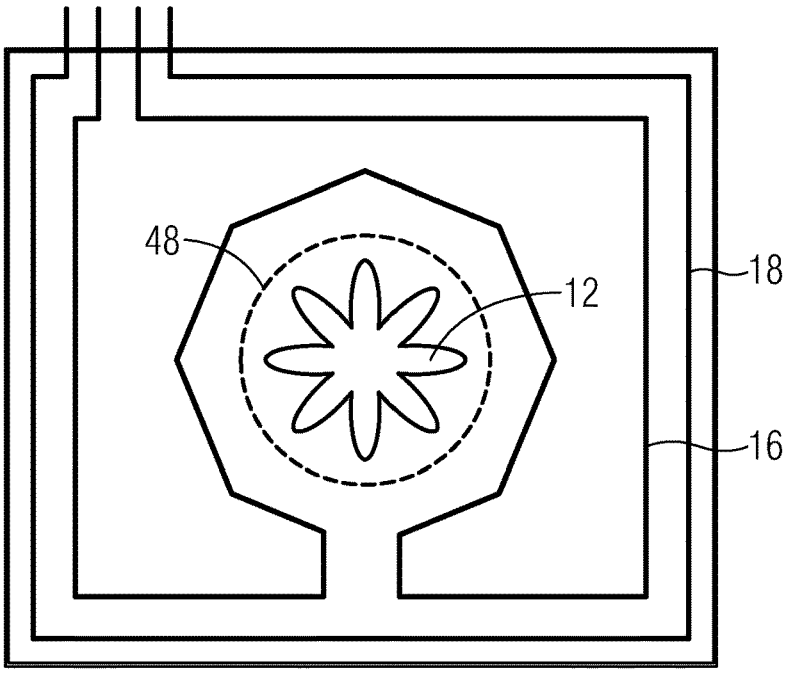
Figure 3:
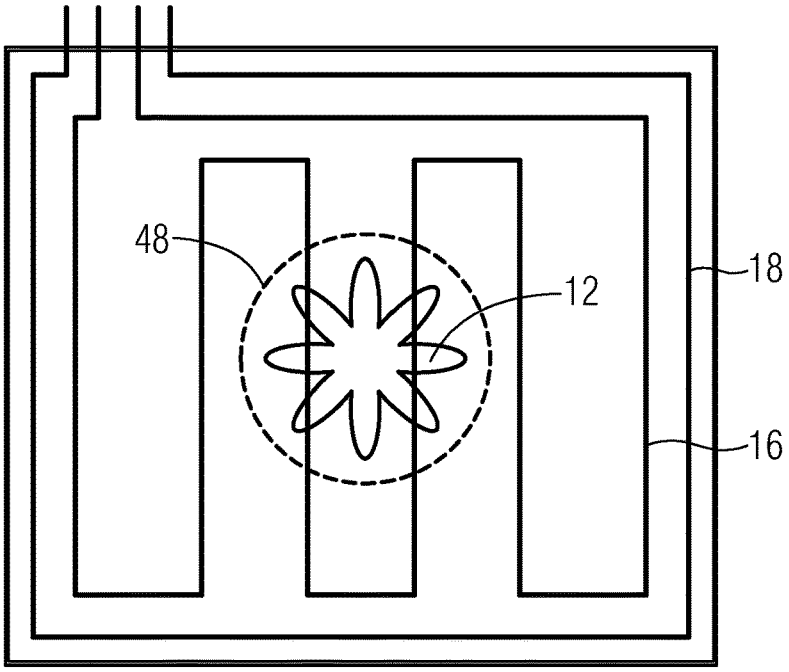
Figure 4:
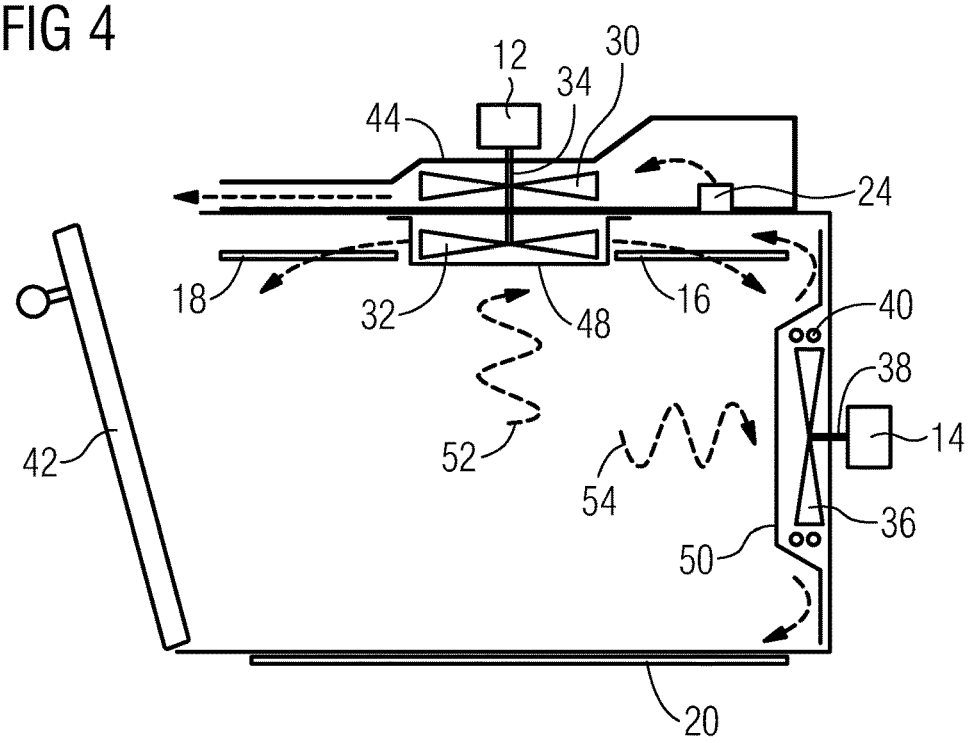
Figure 5:
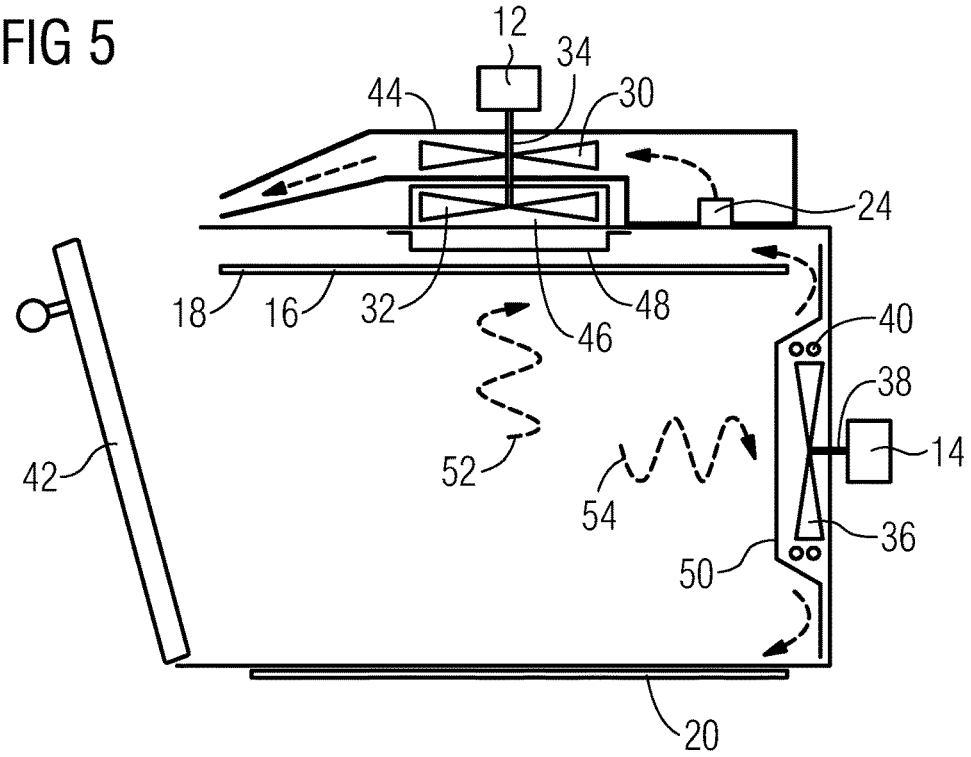
Figure 6:
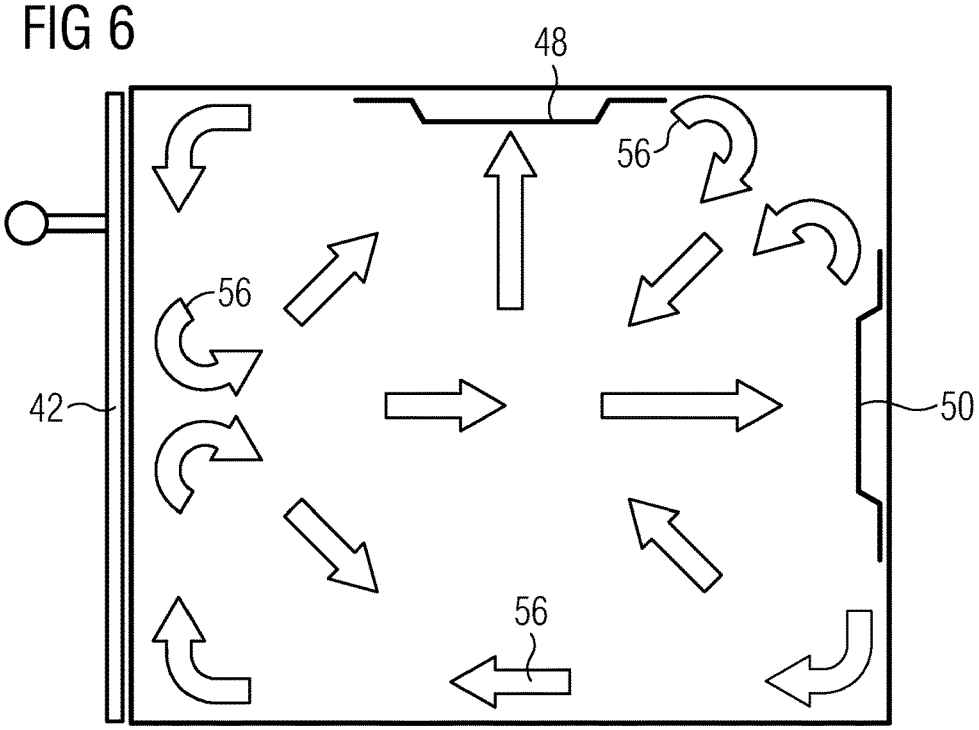
Figure 7:
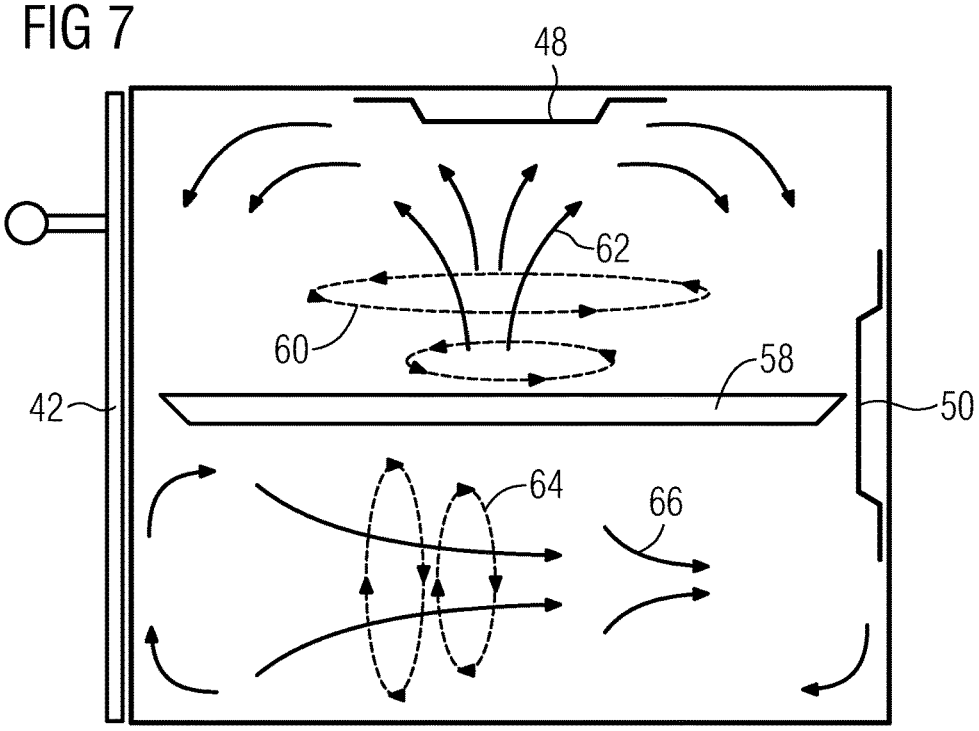
Figure 8:
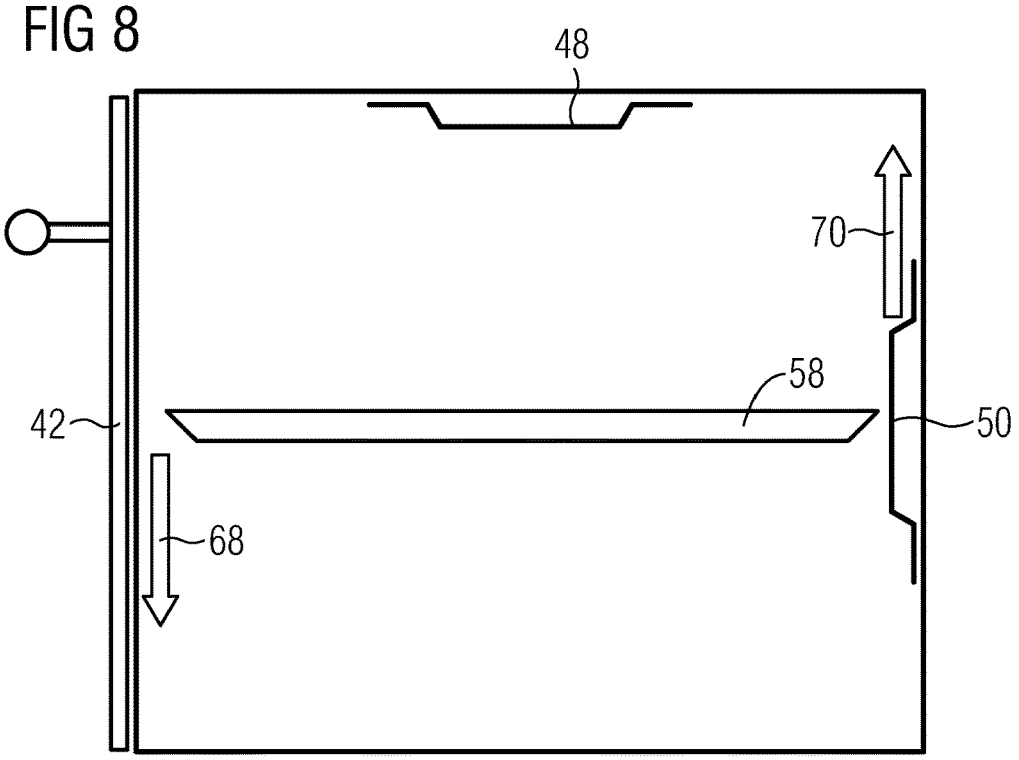
Figure 9:
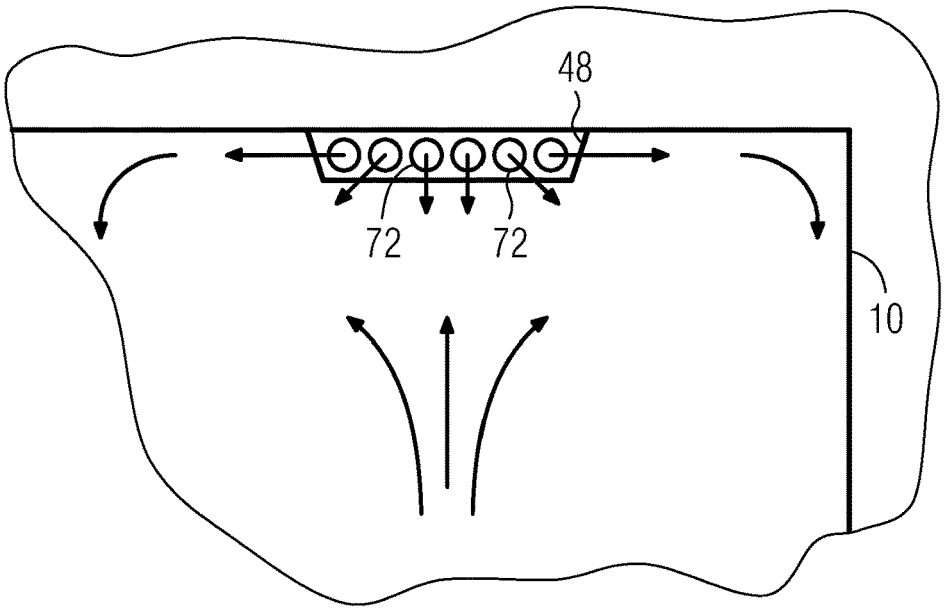
Figure 10:
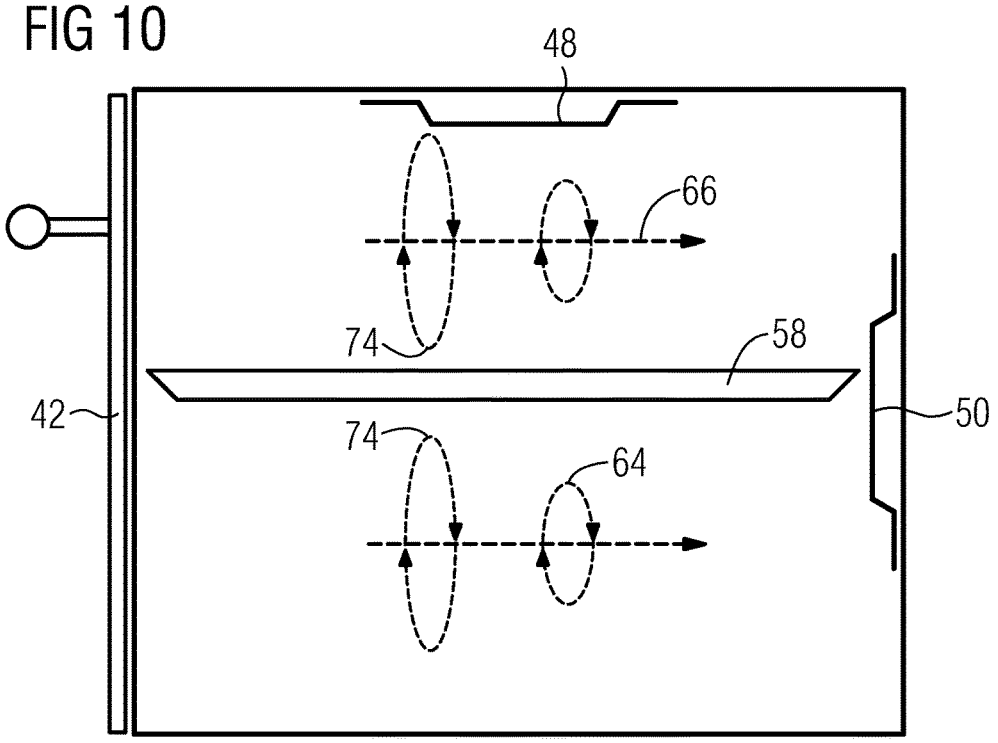
Figure 11:
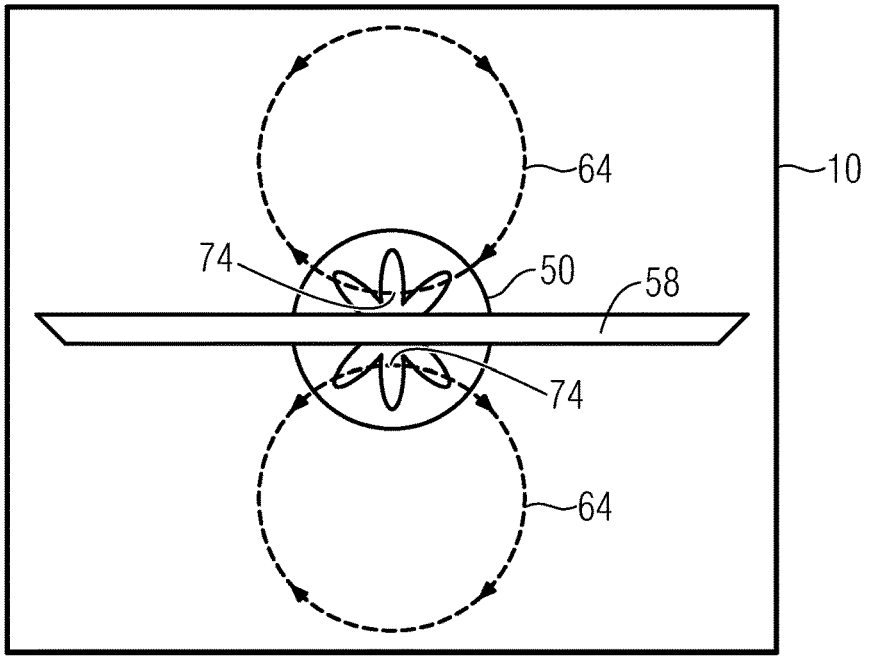

The present invention will be described in further detail with reference to the drawings, in which FIG. 1 illustrates a perspective front view of an oven cavity of a cooking oven according to a first embodiment of the present invention, FIG. 2 illustrates a view from below at the top wall of the oven cavity of the cooking oven according to the first embodiment of the present invention, FIG. 3 illustrates a view from below at the top wall of the oven cavity of the cooking oven according to a second embodiment of the present invention, FIG. 4 illustrates a sectional side view of the oven cavity of the cooking oven according to the first embodiment of the present invention, FIG. 5 illustrates a sectional side view of the oven cavity of the cooking oven according to the second embodiment of the present invention, FIG. 6 illustrates a sectional side view of the oven cavity of the cooking oven showing an air flow pattern according to the present invention, FIG. 7 illustrates a sectional side view of the oven cavity of the cooking oven with a cooking tray showing an air flow pattern according to the present invention, FIG. 8 illustrates a sectional side view of the oven cavity of the cooking oven showing pressure drops according to the present invention, FIG. 9 illustrates a detailed sectional side view of a top convection fan of the cooking oven showing an air flow pattern according to the present invention, FIG. 10 illustrates a sectional side view of the oven cavity of the cooking oven showing an air flow pattern according to the prior art, and FIG. 11 illustrates a sectional front view of the oven cavity of the cooking oven showing an air flow pattern according to the prior art.

FIG. 1 illustrates a perspective front view of an oven cavity 10 of a cooking oven according to a first embodiment of the present invention. The oven cavity 10 includes a top wall, a bottom wall, two side walls and a rear wall. A top convection fan 12 is arranged in the centre of the top wall of the oven cavity 10. In a similar way, a rear convection fan 14 is arranged in the centre of the rear wall of the oven cavity 10. The top convection fan 12 and the rear convection fan 14 are axial convection fans. In this example, the top convection fan 12 is covered by a cover element 48. The rear convection fan 14 is enclosed by a circular heating element 40 and covered by a rear cover element 50.

An inner top heating element 16 is arranged below the top wall of the oven cavity 10. The inner top heating element 16 extends in a plane parallel to the top wall of the oven cavity 10. The inner top heating element 16 comprises a rectangular portion and a circular portion. The circular portion encloses the top convection fan 12. The rectangular portion of the inner top heating element 16 encloses the circular portion. An outer top heating element 18 is arranged below the top wall of the oven cavity 10. The outer top heating element 18 has a rectangular shape and encloses the inner top heating element 16. The outer top heating element 18 extends in a plane parallel to the top wall of the oven cavity 10. The inner top heating element 16 and the outer top heating element 18 are marginally spaced from the top wall of the oven cavity 10. Thus, the inner top heating element 16 and the outer top heating element 18 are arranged inside the oven cavity 10. In this example, the inner top heating element 16 is provided as a grill heating element.

A bottom heating element 20 is arranged above the bottom wall of the oven cavity 10. The bottom heating element 20 has a rectangular shape and extends in a plane parallel to the bottom wall of the oven cavity 10. The bottom heating element 20 is marginally spaced from the bottom wall of the oven cavity 10. Thus, the bottom heating element 20 is arranged inside the oven cavity 10.

Further, the oven cavity 10 comprises a temperature control device 22, an exhaust 24 and a light bulb 26. The exhaust 24 is arranged in the top wall of the oven cavity 10. The temperature control device 22 and the light bulb 26 are arranged in the upper portion of the oven cavity 10. The side walls of the oven cavity 10 comprise guiding devices 28 for baking tray or grids.

FIG. 2 illustrates a view from below at the top wall of the oven cavity 10 of the cooking oven according to the first embodiment of the present invention. FIG. 2 clarifies that the top convection fan 12 is arranged in the centre of the top wall of the oven cavity 10.

The inner top heating element 16 comprises the rectangular portion and the circular portion arranged in the same plane. The rectangular portion of the inner top heating element 16 encloses the circular portion. In turn, the circular portion of the inner top heating element 16 encloses the inner top heating element 16. The outer top heating element 18 is arranged in the same plane as the inner top heating element 16. The outer top heating element 18 has a rectangular shape and encloses the inner top heating element 16.

FIG. 3 illustrates a view from below at the top wall of the oven cavity 10 of the cooking oven according to a second embodiment of the present invention. In this example, the inner top heating element 16 is arranged in a serpentine pattern. The outer top heating element 18 has the same structure as in FIG. 2. The top convection fan 12 is arranged in the centre of the top wall of the oven cavity 10.

FIG. 4 illustrates a sectional side view of the oven cavity 10 of the cooking oven according to the first embodiment of the present invention.

The inner top heating element 16 and the outer top heating element 18 are arranged in the same plane below the top wall of the oven cavity 10. The top convection fan 12 is arranged in the centre of the top wall of the oven cavity 10. The top convection fan 12 includes an upper top propeller 30, a lower top propeller 32 and a vertical motor shaft 34. The rear convection fan 14 includes one rear propeller 36 and a horizontal motor shaft 38. The rear propeller 36 is enclosed by the circular heating element 40. The bottom heating element 20 is arranged below the bottom wall of the oven cavity 10. The oven cavity 10 is closable by an oven door 42.

A cooling channel 44 is arranged above the top wall of the oven cavity 10. The cooling channel 44 extends from the exhaust 24 of the oven cavity 10 to the front side of the cooking oven. The upper top propeller 30 is arranged inside said cooling channel 44. The lower top propeller 32 is arranged inside the oven cavity 10 and covered by a cover element 48. The lower top propeller 32 of the top convection fan 12 generates a vertical swirling 52. In a similar way, the rear propeller 36 of the rear convection fan 14 generates a horizontal swirling 54.

The lower top propeller 32 is arranged at the same plane as the inner top heating element 16 and the outer top heating element 18. This allows that the hot airflow is distributed also to the walls of the oven cavity 10 through orifices of the top cover element 48, so that the temperature is homogeneous distributed within the oven cavity 10. This embodiment is suitable for baking, roasting and grilling purposes, even if a steady and even temperature inside the oven cavity 10 is required.

FIG. 5 illustrates a sectional side view of the oven cavity 10 of the cooking oven according to the second embodiment of the present invention.

The inner top heating element 16 and the outer top heating element 18 are arranged in the same plane below the top wall of the oven cavity 10. The top convection fan 12 is arranged in the centre of the top wall of the oven cavity 10. The top convection fan 12 includes the upper top propeller 30, the lower top propeller 32 and the vertical motor shaft 34. The rear convection fan 14 includes the rear propeller 36 and the horizontal motor shaft 38. The rear propeller 36 is enclosed by the circular heating element 40. The rear propeller 36 of the rear convection fan 14 generates the horizontal swirling 54. The bottom heating element 20 is arranged below the bottom wall of the oven cavity 10. The oven cavity 10 is closable by an oven door 42.

The cooling channel 44 is arranged above the top wall of the oven cavity 10. The cooling channel 44 extends from the exhaust 24 of the oven cavity 10 to the front side of the cooking oven. The upper top propeller 30 is arranged inside said cooling channel 44. The lower top propeller 32 is arranged inside a recess 46 formed in the top wall of the oven cavity 10. The cover element 48 is arranged below the lower top propeller 32. The lower top propeller 32 of the top convection fan 12 generates the vertical swirling 52.

The lower top propeller 32 is arranged above the plane of the inner top heating element 16 and the outer top heating element 18. The lower top propeller 32 revolves only the air inside the oven cavity 10 in such a manner that the hot stream in the vertical plane will always be in the centre of the oven cavity 10. This effect results from the principle that cold air has a higher density and mass than hot air, so that during the vertical swirling only the hot air is forced to the centre of the oven cavity 10. This embodiment is suitable for grilling purposes, if high temperatures are required and the cooking process is performed in the centre of the oven cavity 10.

FIG. 6 illustrates a sectional side view of the oven cavity of the cooking oven showing an air flow pattern according to the present invention. A number of arrows 56 represent the airflow inside the cooking oven 10. Said arrows 56 form the air flow pattern.

The top convection fan 12 and the rear convection fan 14 generate two main streams of hot air. The one main stream of hot air extends along a vertical direction. The other main stream of hot air extends along a horizontal direction. There are strong turbulences in the central portions of the oven cavity 10, while laminar airflows occur close to the walls of said oven cavity 10.

Without any cooking tray in the oven cavity 10, the airflow is very turbulent in the horizontal plane as well as in the vertical plane, which is suitable for preheating the oven cavity 10. Said turbulent airflow is also suitable for cooking by using a grid or small cooking tray inside the oven cavity 10.

FIG. 7 illustrates a sectional side view of the oven cavity 10 of the cooking oven with a cooking tray 58 showing an air flow pattern according to the present invention. The cooking tray 58 is arranged at half height inside the oven cavity 10. The cooking tray 58 changes the airflow in the oven cavity 10.

A velocity head vector 60 of the airflow in the vertical plane is very strong. The corresponding airflow in the vertical plane is turbulent. An airflow path 62 of the airflow in the vertical plane is directed to the ceiling of the oven cavity 10. The airflow from the rear convection fan 14 is blocked in the space above the cooking tray 58.

The airflow from the rear convection fan 14 acts in the space below the cooking tray 58. A velocity head vector 64 of the airflow in the horizontal plane is very strong. The corresponding airflow in the horizontal plane is turbulent. An airflow path 66 of the airflow in the horizontal plane is directed to the rear wall of the oven cavity 10. The airflow from the rear convection fan 14 is only in the space below the cooking tray 58. The airflow from the top convection fan 12 is blocked in the space below the cooking tray 58.

The top convection fan 12 is responsible for the parameters of the hot airflow above the cooking tray 58. Thus, the top convection fan 12 controls the quality of cooking, baking and/or browning. Further, the rear convection fan 14 may heat up the bottom of the cooking tray 58 and the air below said cooking tray 58.

FIG. 8 illustrates a sectional side view of the oven cavity 10 of the cooking oven showing pressure drops 68 and 70 according to the present invention. The pressure drop 68 from the top convection fan 12 extends downwards from the upper portion to the lower portion of the oven cavity 10. In contrast, the pressure drop 70 from the rear convection fan 14 extends upwards from the lower portion to the upper portion of the oven cavity 10.

The cooking system according to the present invention bases on the pressures of the airflows from the top convection fan 12 and the rear convection fan 14. In order to maintain the equilibrium of the pressure drops 68 and 70, the airflows between the lower portion and the upper portion of the oven cavity 10 are controlled.

FIG. 9 illustrates a detailed sectional side view of a top convection fan of the cooking oven showing an air flow pattern according to the present invention. The top cover element 48 includes a plurality of orifices 72 arranged at the peripheral side wall of said top cover element 48. The orifices 72 are formed as circular holes.

FIG. 10 illustrates a sectional side view of the oven cavity of the cooking oven showing an air flow pattern according to the prior art. The cooking oven according to the prior art comprises the rear convection fan 14, but not any top convection fan 12.

In the conventional cooking oven the airflow from the rear convection fan 14 is split into two or more parts depending on the number of cooking tray 58 placed in the oven cavity 10 at the same time. The airflow generated by the rear convection fan 14 cannot cover evenly the surface of the cooking tray 58 from above or below. The airflow path 66 in the horizontal plane allows only a tangential heating 74 of the cooking tray 58.

FIG. 11 illustrates a sectional front view of the oven cavity of the cooking oven showing an air flow pattern according to the prior art. FIG. 11 clarifies the tangential heating 74 of the cooking tray 58 by the airflow path 66 in the horizontal plane.

In contrast, the present invention allows an airflow, which covers evenly the surface of the cooking tray 58.

The cooking oven according to the present invention provides several operating modes. In a simultaneous operating mode, both convection fans 12 and 14 are activated at the same time. The top convection fan 12 generates the vertical swirling, like a tornado. The rear convection fan 14 generates the horizontal swirling. In a tornado operating mode, only the top convection fan 12 is activated and generates the vertical swirling or the tornado.

In an alternating operation mode of a first kind, the rear convection fan 14 and the heating elements 16, 18, 20 and/or 40 are activated at the same time. Then, only the top convection fan 12 is activated in order to homogenize the heat inside the oven cavity 10, wherein the rear convection fan 14 and the heating elements 16, 18, 20 and 40 are deactivated.

In an alternating operation mode of a second kind, the top convection fan 12 and the heating elements 16, 18, 20 and/or 40 are activated at the same time. Then, only the rear convection fan 14 is activated, wherein the top convection fan 12 and the heating elements 16, 18, 20 and 40 are deactivated.

In a classical operation mode, only the rear convection fan 14 is activated, which corresponds with a conventional cooking oven.

The top convection fan 12 acts as a dispenser of the heat, which has been accumulated in the upper portion of the oven cavity 10. Thus, said accumulated heat can be used for the further cooking process. Moreover, the top convection fan 12 acts as booster of the heat transfer. The top convection fan 12 creates a higher turbulence of the airflow, which finally allows a uniform heating of the walls of the oven cavity 10 in order to obtain the same temperature around the food stuff.

The cooking oven according to the present invention allows a reduced cooking time, when both convection fans 12 and 14 are activated. The energy consumption is also reduced.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 oven cavity
12 top convection fan
14 rear convection fan
16 inner top heating element
18 outer top heating element
20 bottom heating element
22 temperature control device
24 exhaust
26 light bulb
28 guiding device
30 upper top propeller
32 lower top propeller
34 vertical motor shaft
36 rear propeller
38 horizontal motor shaft
40 circular heating element
42 oven door
44 cooling channel
46 recess
48 top cover element
50 rear cover element
52 vertical swirling
54 horizontal swirling
56 arrow
58 cooking tray
60 velocity head vector in the vertical plane
62 airflow path in the vertical plane
64 velocity head vector in the horizontal plane
66 airflow path in the horizontal plane
68 pressure drop from the top convection fan 12
70 pressure drop from the rear convection fan 14
72 orifice
74 tangential heating of the cooking tray 58

The invention claimed is:

1. A cooking oven provided for heat transfer by convection, in particular for a domestic appliance, comprising:

at least one top convection fan arranged in a central portion of a top wall of an oven cavity, at least one rear convection fan arranged in a central portion of a rear wall of the oven cavity, at least one top heating element arranged in an upper portion of the oven cavity and below the top wall of the oven cavity, a cover element located within the oven cavity and disposed over the at least one top convection fan such that the at least one top convection fan is positioned between the top wall of the oven cavity and the cover element, wherein the cover element comprises a plurality of orifices arranged at a peripheral side wall thereof, and at least one rear heating element arranged in a rear portion of the oven cavity and in front of the rear wall of the oven cavity, wherein the at least one top convection fan and the at least one rear convection fan are axial propellers, and wherein at least one top propeller of the at least one top convection fan and at least one rear propeller of the at least one rear convection fan are arranged inside the oven cavity.

2. The cooking oven according to claim 1, wherein the at least one rear heating element encloses the at least one rear propeller of the at least one rear convection fan.

3. The cooking oven according to claim 2, wherein the at least one rear heating element includes at least one circular heating element enclosing the at least one rear propeller of the at least one rear convection fan.

4. The cooking oven according claim 1, wherein the at least one top propeller of the at least one top convection fan is arranged in the same horizontal plane as the at least one top heating element.

5. The cooking oven according to claim 4, wherein the at least one top heating element encloses the at least one top propeller of the at least one top convection fan in the horizontal plane.

6. The cooking oven according to claim 1, wherein the at least one top propeller of the at least one top convection fan is arranged above the at least one top heating element.

7. The cooking oven according to claim 6, wherein the at least one top propeller of the at least one top convection fan is arranged inside a recess formed in the top wall of the oven cavity.

8. The cooking oven according to claim 1, wherein the cooking oven comprises at least one inner top heating element and at least one outer top heating element.

9. The cooking oven according to claim 8, wherein the at least one outer top heating element encloses the at least one inner top heating element, wherein the at least one inner top heating element and the at least one outer top heating element are in the same horizontal plane.

10. The cooking oven according to claim 1, wherein at least one bottom heating element is arranged below a bottom wall of the oven cavity.

11. The cooking oven according to claim 1, wherein the cooking oven comprises at least one cooling channel arranged above the oven cavity.

12. The cooking oven according to claim 11, wherein the at least one cooling channel extends from an exhaust in the top wall of the oven cavity to a front side of the cooking oven.

13. The cooking oven according to claim 11, wherein the at least one top convection fan comprises at least one further top propeller arranged inside the at least one cooling channel.

14. The cooking oven according to claim 13, wherein the at least one top convection fan comprises an upper top propeller arranged inside the at least one cooling channel and a lower top propeller arranged inside the oven cavity.

15. The cooking oven according to claim 14, wherein the upper top propeller and the lower top propeller are attached at one vertical motor shaft of the at least one top convection fan.

16. The cooking oven according to claim 1, further comprising a cooling channel disposed above the top wall of the oven cavity, wherein the at least one top convection fan comprises first and second top propellers that are vertically displaced from one another and that are disposed on a common rotational axis, wherein the first top propeller is positioned within the cooling chamber, and the second top propeller is positioned within the oven cavity.

* * * * *